US005996263A

United States Patent [19]

Black

[11] Patent Number: 5,996,263

[45] Date of Patent: Dec. 7, 1999

[54] INTERNALLY ILLUMINATED MATRIX SIGN

[75] Inventor: F. Martin Black, Greensboro, N.C.

[73] Assignee: ReaderVision, Inc., Greensboro, N.C.

[21] Appl. No.: 09/008,706

[22] Filed: Jan. 16, 1998

[51] Int. Cl.[6] ..... G09F 13/04; G08B 5/36

[52] U.S. Cl. ..... 40/452; 40/431; 340/815.53; 340/815.54

[58] Field of Search ..... 40/431, 430, 493, 40/494, 501, 502, 503, 952, 505; 345/59; 340/815.53, 815.54

[56] References Cited

U.S. PATENT DOCUMENTS

| | | | |
|---|---|---|---|
| 3,273,271 | 9/1966 | Werner | 40/77 |
| 3,383,785 | 5/1968 | Werner | 40/76 |
| 3,826,027 | 7/1974 | Abbema | 40/505 X |
| 3,919,794 | 11/1975 | Hunter, Jr. | 40/30 |
| 4,002,022 | 1/1977 | Lopez | 58/126 |
| 4,189,859 | 2/1980 | Ahlgren | 40/505 |
| 4,381,616 | 5/1983 | Saxer | 40/502 |
| 4,597,209 | 7/1986 | Hukill | 40/447 |
| 4,615,131 | 10/1986 | Wakatake | 40/449 X |
| 4,761,905 | 8/1988 | Black | 40/447 |
| 4,912,442 | 3/1990 | Black | 340/764 |
| 5,003,716 | 4/1991 | Dyar | 40/503 |
| 5,057,828 | 10/1991 | Rousseau | 40/449 X |
| 5,297,353 | 3/1994 | Ghalayini | 40/503 |
| 5,315,776 | 5/1994 | Strawbridge et al. | 40/505 |
| 5,412,891 | 5/1995 | Black et al. | 40/447 |
| 5,416,996 | 5/1995 | Clemens et al. | 40/502 |
| 5,483,765 | 1/1996 | Karsten et al. | 40/505 |
| 5,533,289 | 7/1996 | Hoffman | 40/594 X |

*Primary Examiner*—Terry Lee Melius
*Assistant Examiner*—Rodrigo J. Morales
*Attorney, Agent, or Firm*—Rhodes & Mason, PLLC

[57] ABSTRACT

An improved internally illuminated display apparatus for displaying indicia at a front of the apparatus. The invention is comprised of a light source for providing internal illumination to the display. A plurality of axles are connected to the light source to transfer the light emitted from the source to a plurality of light emitting locations located along the length of the axle. Display elements are rotationally connected to the axles at the light emitting locations and include display faces that may be rotated to produce an image on the front face of the apparatus.

45 Claims, 4 Drawing Sheets

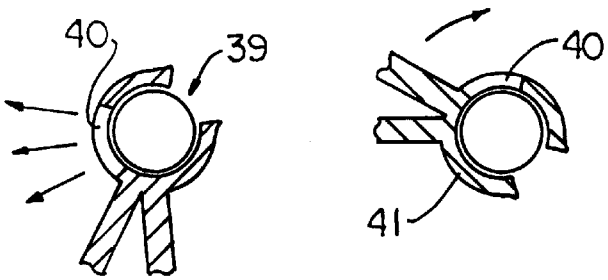
FIG. 5A
FIG. 5B
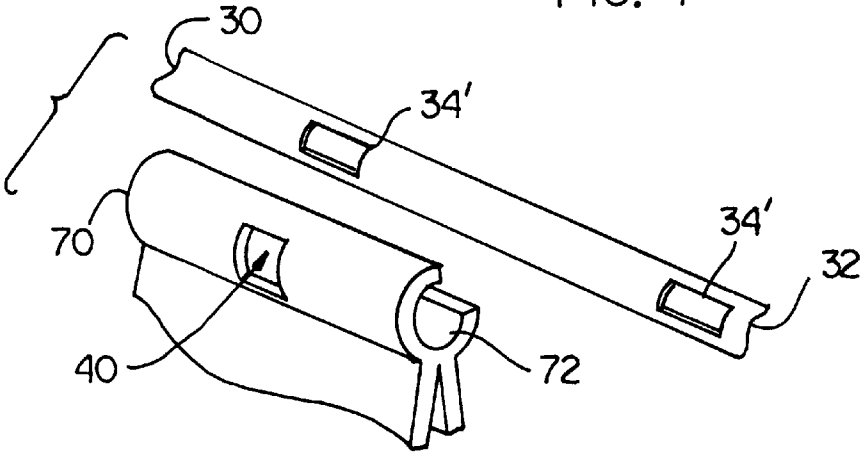
FIG. 4
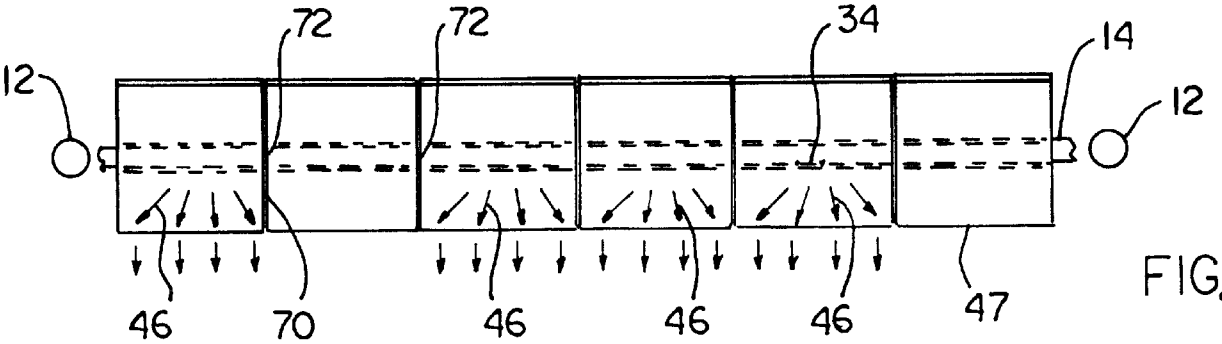
FIG. 6

INTERNALLY ILLUMINATED MATRIX SIGN

FIELD OF THE INVENTION

The present invention relates to a display apparatus for displaying alphanumeric and/or graphical information. More particularly, the present invention relates to a display having a matrix of columns and rows comprised of display elements that are visible by ambient lighting conditions and through internal illumination to show a variety of display arrangements.

BACKGROUND OF THE INVENTION

The present invention provides improvements in changeable signs. The inventor of this application, Fred M. Black, is the inventor of U.S. Pat. No. 4,761,905 entitled "Scanned Electromechanical Display" and U.S. Pat. No. 4,912,442 entitled "Scanned Electromechanical Alphanumeric Display Apparatus". Additionally, Fred M. Black is a co-inventor of U.S. Pat. No. 5,412,891 entitled "Changeable Sign". The disclosures of these patents are hereby incorporated herein by reference. The '905 and '442 patents provide a description of certain designs of the prior art in the field of the present invention. Additional improvements are disclosed in application Ser. No. 08/761,125, filed Dec. 6, 1996, and application Ser. No. 08/831,071, filed Apr. 1, 1997, both of which are incorporated herein by reference.

The cited patents and applications disclose sign elements which can display alphanumeric or graphical information through the selective arrangement of individual display elements. The display elements are rotatably mounted elements that have multiple display faces, only one of which is noticeable to an observer at a time. The overall pattern of pixel display faces makes up an alphanumeric or graphical indicia of the sign. The present invention has these notions in common, but provides improved design features to create a superior product.

The previous designs require the use of an external light source during low lighting conditions to provide illumination of the display face. Although this arrangement performs adequately, it requires special mounting hardware for mounting the external light source. In many instances, the displays are mounted in small, isolated positions that do not have space or available positions to mount the external lighting.

There is a need for a display apparatus made up of individually illuminated pixels. Present displays provide for internal illumination of the entire display face or for entire columns or rows of pixels. The individual pixels can not be either "on" in which they are internally illuminated or "off" having no internal illumination. There is no ability for the individual pixels to be either "on" or "off" in correlation to the display being presented to the viewer.

Thus, there exists a need for a display apparatus having individually illuminated display pixels which together form a display front for showing alphanumeric or graphical indicia.

SUMMARY OF THE INVENTION

This invention fulfills this need in the art by providing an improved internally illuminated or light emitting display apparatus. The apparatus has a display face made up of a number of display elements aligned in rows and columns to give the appearance of one continuous surface. Each display element has two display faces that can be rotated to form a pattern that can be words, images and various other messages. The display elements are rotationally connected to light emitting axles which emit light through the display faces, allowing them to be seen during low ambient light conditions. The display faces may further include reflective and transparent surface indicia to further improve visibility in both external and internal light.

In one aspect the present invention includes a plurality of axles connected to a light source. The axles are capable of emitting light at a number of selected locations along their length. Display elements are rotationally mounted to the axles at these selected locations and have shutters that are operable at selective rotational positions of the display elements to vary the amount of light that is emitted through the axles to the display elements. A trigger provides for selective rotation of the display elements about the axles.

The apparatus may further include a light source having two units located at the ends of the axles. Each of the units of the light sources may be independently capable of illuminating the axles if the other unit fails. Alternatively, there may be only a single light source unit located at one of the axle ends for illuminating the axles. The apparatus may further include light tubes for connecting the axle and light source and directing the light from the source to the axles. The light tubes may further include at least one reflector to enhance the light transfer from the light source to the light tube. In one embodiment, the light tubes are flexible fiber optic bundles.

The trigger for selective rotation of the display elements about the axles may include a number of vertically arrayed carriages carrying a number of actuators to selectively pivot the display elements and a cable drive system.

The axles may be constructed of a solid light transmitting material to allow the light to pass along the length of the axle. The axles may emit light at the selected locations at an angle substantially perpendicular to the axle axis. The axles may be rigid members that are placed over the light source and allow for connecting of the display elements.

The display elements connected to the axles typically each include at least two visually different display faces, only one of which will be displayed at a given time for providing a desired arrangement of the display faces at the front of the display apparatus. The display element may have two transparent display faces that both allow for the passage of light or a first display face which allows for the passage of light and a second display face that is opaque to occlude the passage of light. A display face may include a molded lens to distribute the light emitted from the light source outwardly away from the display face. One or both of the display faces may further include a trans-reflective label having transparent and reflective indicia spaced about the label.

The shutters may take the form of sleeves with apertures to permit the selective passage of light from the axles outwardly through the apertures. The shutters may further be formed of a resilient material and have an open slot to permit mounting of the sleeve over an axle by the opening of the slot over the axle and its resilient closure to secure the shutter in position on the axle. The display elements may include two display faces and struts extending outwardly from the sleeve to support one of the display faces.

Accordingly, a second aspect of the present invention includes a frame and a number of stationary axles aligned in parallel arrangement connected to the frame that emit light at a number of locations along the length. Display elements are mounted on the axle with each element having a number of visually distinct display faces, only one of which may be displayed at a given time to provide a desired arrangement of the display faces on the front of the apparatus. The display element also includes a shutter that is rotationally attached to the axle having an aperture which controls the amount of light emitted from the axle through to the display face. The shutter arm connects the display face to the shutter. A triggering mechanism is located behind the display elements opposite the front of the apparatus for rotating the display elements.

The shutter aperture is aligned with one of the display faces such that when the shutter is rotated about the axle and the aperture is positioned over the light emitting location on the axle, light passes through from the axle and internally illuminates the display face. The shutter may also be rotated on the axle such that the aperture is positioned away from the light emitting location so that light passing from the axle is in a direction away from the display face. The shutter may further be substantially "C"-shaped to conform to the dimensions of the axle to allow rotation of the display element about the axle.

The dimensions of the display elements may further allow them to be placed close enough together, in horizontal and vertical planes, that they appear as one substantially continued surface. The axles are preferably spaced a distance apart so that the display elements are free to rotate without interfering or touching the adjacent vertical or horizontal display elements.

Accordingly, a third aspect provides for a number of light emitting axles that are capable of emitting light at selected locations. Display elements are rotationally mounted to the axles at the light emitting locations. The elements are arranged in rows and columns to provide a message board on the display front. The display elements include a shutter that controls the amount of light emitted from the axle to the display elements.

The axles may include a plurality of individual light sources located at the selected locations.

BRIEF DESCRIPTION OF THE DRAWINGS

This invention will be better understood from the reading of the detailed description of the preferred embodiment along with a review of the drawings, wherein like items are indicated by the same reference number:

FIG. 4 is an enlarged, partially exploded view of an axle and display element shutter for either embodiment;

FIG. 5A is an enlarged, sectional view of the shutter aperture located over the axle's light emitting location;

FIG. 5B is an enlarged, sectional view of the shutter covering the light emitting location of the axle;

FIG. 6 is a partial, top view of a row of display elements arranged on an axle;

DETAILED DESCRIPTION OF THE PREFERRED EMBODIMENT

Figure 1:
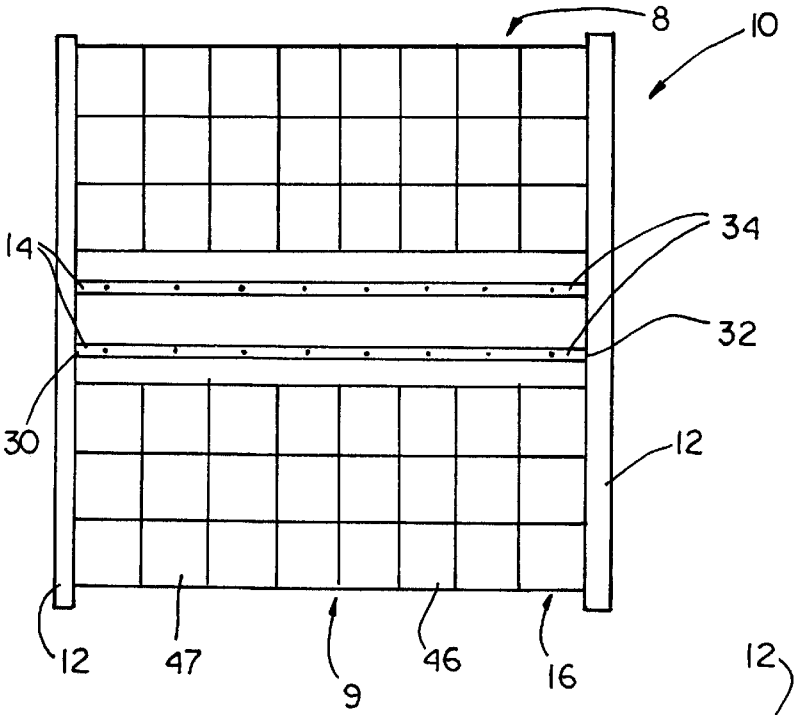
FIG. 1 is a front elevational view of a display apparatus according to a preferred embodiment of the invention with display elements removed from two of the rows to show the underlying axles.

With reference to FIG. 1, the overall design of the preferred embodiment of the present display apparatus is shown. The apparatus includes a light source 12 for providing internal illumination of the display. A plurality of axles 14 are connected to the light source to transfer the light emitted from the source 12 along the length of the axle. Display elements 16 are rotationally connected to the axles and include display faces 46, 47 that may be selectively positioned facing the viewer (as in FIG. 1) to produce a pattern of display faces 46, 47 to make up an image on the front face 9 of the apparatus that is visible to the viewer.

The light emitted from the light source 12 is transferred to the axles 14 and into the display elements 16, where it ultimately provides for internal illumination of one of the display faces 46, 47. The embodiment depicted in FIG. 1 has two light sources 12 located at opposite ends of the axles 14. The light sources 12 in this arrangement complement one another to provide for transmission of light along axles 14 and thus to the display faces 46, 47. Thus, as the light from one source 12 attenuates along the axle 14, the light from the other source increases. Additionally, the light source 12 provides the same amount of light to each axle 14 to provide for an even, consistent lighting throughout the entire apparatus. The light sources 12 further are a redundant system so that if one of the sources 12 fails, the other functioning source may provide light to the entire apparatus. It will be understood to one in the art that there are numerous possible arrangements for the light sources, including but not limited to a single light source apparatus or a three light source apparatus. This invention contemplates the use of any suitable light source arrangement.

The light sources 12 are commonly known in the art and may include fluorescent tubes, neon tubes, incandescent bulbs or other suitable source, such as LED's, lasers, electroluminescent materials, etc. The light sources 12 may be powered on or off depending upon the external light conditions. During daylight or high external ambient lighting conditions, the display face 9 is typically visible to a viewer without the need for internal illumination of the display faces 46, 47. During these conditions, the light source 12 may be powered off to save energy and to increase the operational life of the light source without adversely affecting the visibility of the apparatus face 9. During nighttime or conditions of low external light, the light source can be powered on to provide for internal illumination and maximum contrast and visibility of the displayed pattern of faces 46, 47.

Figure 3:
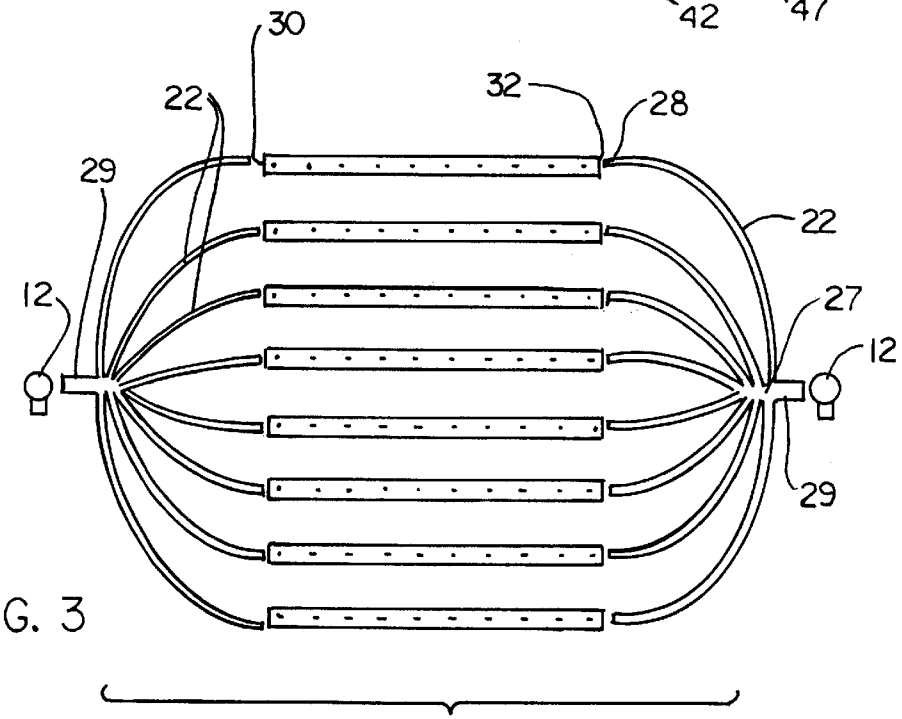
FIG. 3 is a front elevational view representing the elements of an alternative embodiment of the present invention having two exterior light sources connected to the axles by light tubes.

The axles 14 are substantially linear tubes having two opposite ends 30, 32. There may be any number of axles in the apparatus and may be arranged in various positions depending upon the desired display front 9. Embodiments in FIGS. 1 and 3 illustrate the axles arranged in parallel alignment to form a substantially rectangular area that forms the display front 9. The axles 14 are preferably rigid to provide a base for connecting and supporting the display elements 16 and to allow for mounting of the axles within the apparatus 10 using only a minimum amount of external support. For example, the axles shown in FIGS. 1 and 3 may be attached to the apparatus at only the axle ends 30 and 32. Alternatively, and preferably, intermediate supports between the display elements help support the axles 14.

The axle ends 30, 32 are positioned adjacent to the light source 12 to collect and direct the emitted light into the axle as shown in FIGS. 1 and 3. The ends 30, 32 are substantially open and, due to their close proximity to the light source 12, are able to capture a substantial amount of light emitted from the source 12.

The axle allows for the light that is emanating from the light source 12 to pass along the length of the axle. This design allows for the light source 12 to provide relatively even amounts of lighting throughout the length of the axle. For example, the amount of light in the axle at a position near the ends 30, 32 is approximately equal to the light in the interior of the axle. This provides for apparatus face 9 to have consistent illumination throughout to give a consistent and higher quality appearance.

As shown in FIG. 3, light tubes 22 may be used to guide the light from the light source 12 to the axles 14. These light tubes function similarly to the axles in that they act as a guide to transfer the light from the light source to the axles. Light tubes 22 provide for the light source 12 to be positioned a distance away from the axles 14 and in a variety of positions. The light tubes include a first end 27 located in proximity to the light source 12 that captures light emitted from the source and guides it along the length to a second end 28 connected to the axle end 30 or 32 as shown in FIG. 3. The light tubes 22 can be non-linear to allow for a variety of enclosure configurations and still adequately transfer light from the light source to the axle. In one embodiment, the first end 27 may start as a single bundle 29 at the light source 12 and then split into separate light tubes 22 leading to each axle. For example as shown in FIG. 3, a single bundle 29 splits into eight individual light tubes. Preferably, the amount of light emitted from the light source 12 is directed into the light tubes 22 and axles 16 with a minimum of transfer loss. This provides for the most efficient lighting system with a minimum of "escaped" light that is emitted from the light source 12 but does not reach the display elements 16.

In an embodiment having only a single light source 12 located at one of the axle ends 30, 32, a reflective material is placed at the end opposite the light source. The reflective material provides for light that travels the length of the axle to reflect back into the axle and be recaptured. Without reflective material at the axle end, the light that travels the axle length would be lost and instead would be dispersed into the general background of the pixels, possibly reducing contrast. Reflective material may further be placed on the ends of a two-piece axle to capture the maximum light usage. For example, a display having an 8-foot span may include two 4-foot length axles abutted together in the center of the display opposite the light source 12. The ends that abut together may be provided with reflective material to capture the maximum amount of light.

Figure 2:
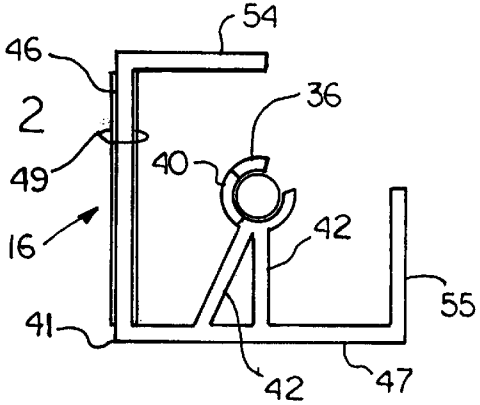
FIG. 2 is an enlarged, side elevational view of a display element for the embodiment of FIG. 1.

Display elements 16 are rotationally connected along the axles 14. As seen in FIG. 2, the display elements include a shutter 36, shutter arms 42, display faces 46, 47, and ramp surfaces 54, 55. The shutter 36 is substantially "C"-shaped to fit around the tubular axle, giving the display element a rotational connection to the axle. Preferably, the shutter is constructed of a resilient material such that the opening 39 defined by the "C"-shape can be enlarged to fit over the axle 14. The shutter constricts to its normal orientation and size to form a bearing for a secure mount on the axle but still allow rotation of the shutter around the axle.

The shutter 36 further includes an aperture 40 as best shown in FIG. 4. The aperture 40 is sized to extend over the light-emitting axle to allow the light from the axle 14 to pass through the shutter 36 to the display face 46 located adjacent to the aperture as shown in FIG. 2. When the shutter 36 is rotated around the axle, the illuminated display face 46 is rotated away from the front of the apparatus and the non-illuminated display face 47 faces the front. The contrasting illuminated/non-illuminated faces allow for the various arrangements on the front of the apparatus.

The display faces 46, 47 are connected to the shutter 36 by shutter arms 42 as shown in FIG. 2. The display faces 46, 47 are joined along a common edge 41 in a substantially perpendicular orientation, so only one display face will be visible by a viewer at a time. The display elements 16 are located on the axles 14 such that each axle supports a substantially continuous horizontal row of display faces. Likewise, the axles are located a distance apart approximately equal to the height of a face 46, 47 to form a substantially continuous column of display faces. This arrangement of display face rows and columns gives the appearance of a substantially continuous display front to the apparatus 9, as shown in FIG. 1. The distance between display elements must allow for the display elements 16 to freely rotate about the axle without interfering with adjacent horizontal and vertical display elements but also close enough together to maximize the appearance of solidity and to prevent the escape of unwanted stray light emanating from the axles.

The axles 14 transfer light emitted from the light source 12 along their length. The shutters mounted on the axles prevent light from being emitted from the axle and seen by the viewer except at light emitting locations 34. As shown in FIG. 6, the shutter ends 70, 72 are placed in close horizontal proximity so that little or no light escapes between adjacent shutters. Likewise, vertically adjacent display elements are placed in close proximity to prevent light from escaping. Light is emitted at the apertures 40, which are the only front-facing positions along the length of the axles that are not covered by the shutter bodies. As shown in FIGS. 1 and 3, the light emitting locations 34 formed by the apertures may be arranged such that they form an array of rows and columns to provide a message to be displayed on the apparatus front 9. This arrangement provides for only the display elements 16 and faces 46, 47 to be internally illuminated. Preferably, the light emitted at these locations 34 is perpendicular to the axle axis. The axles may be constructed of solid light transmitting material such as LUCITE® transparent acrylic resin rods deformed to produce side emission at the light emitting locations 34. In a preferred embodiment, the axles include indentations 34' which cause light to be emitted from the axles at the indentation locations. This axle can be sheathed in a further clear sleeve to prevent the indentations from interfering with display element rotation. In another embodiment, the sleeve may be generally opaque with transparent sections serving as light emitting locations 34.

An alternative embodiment of the light source provides for the axles 14 to be the light source 12. By way of example, the axle may include a series of individual light sources located at the emitting locations 34 to provide light to the display elements 16 and faces 46, 47. Another alternative is for the axle 14 to be a fluorescent tube, neon tube, or made of incandescent bulbs or other suitable light sources. In these embodiments, the exterior shell of the axle may be a rigid tube to protect the contained light source and provide a mounting structure for the display elements 16.

A first display face 46 is located opposite from said shutter aperture 40 such that light emitted through the axle 14 is radiated through to the display face. The aperture 40 is sized such that the light is evenly distributed throughout the entire display face 46. The second display face 47 is located opposite the shutter body so no light emits through to the face 47 when it is rotated to the display front 9. As no light emits through the display face 47, shutter arms 42 can be attached to the interior of this face as shown in FIG. 2 without interfering with the internal illumination. In an alternative embodiment, both display faces may be positioned opposite shutter apertures 40 to provide each with internal illumination. In this embodiment, the shutter arms 42 are preferably positioned to ensure they do not interfere with the display face illumination.

The display faces 46 located opposite the shutter aperture 40 are constructed of a translucent or transparent material to allow the emitted light to radiate through to the viewer. This design provides for improved visibility of the display faces 46 and display apparatus during low light conditions. The display face 46 may further include a molded lens construction 49, such as a molded-in Fresnel type lens, to help distribute the light emitted from the axle 14 out away from the display front 9 and to the viewer. The display face may also include trans-reflective labels having reflective dots, lines and other indicia printed on a transparent material. The reflective portions could be equally spaced and allow for light to be emitted between them. The ratio of reflective area to transmissive area would be about 80% for optimum visibility in both high and low light conditions. The trans-reflective display faces would provide high visibility during daylight hours by reflecting ambient lighting and actually emit light during low or minimal ambient light conditions.

The second display face 47 is visually different from the first display face 46 such that the display front can be altered by rotating the display element to show either the first or second face. If both faces were visually the same, the rotation of one display face to another would be of no visual consequence. One embodiment includes the second display face being opaque to occlude the passage of light. This display face 47 may include colored labels, surfaces, trans-reflective materials or other indicia that are visible by ambient light. In an embodiment in which both faces 46 and 47 are transparent, they may be made visually different by labels, colors, or other differentiating media.

The display elements 16 further include a pair of ramp surfaces 54, 55 attached to the display faces opposite the edge 41. The ramp surfaces 54, 55 are positioned substantially perpendicular to the display face to which they are attached and substantially parallel to the opposite display face as shown in FIG. 2.

Figure 7:
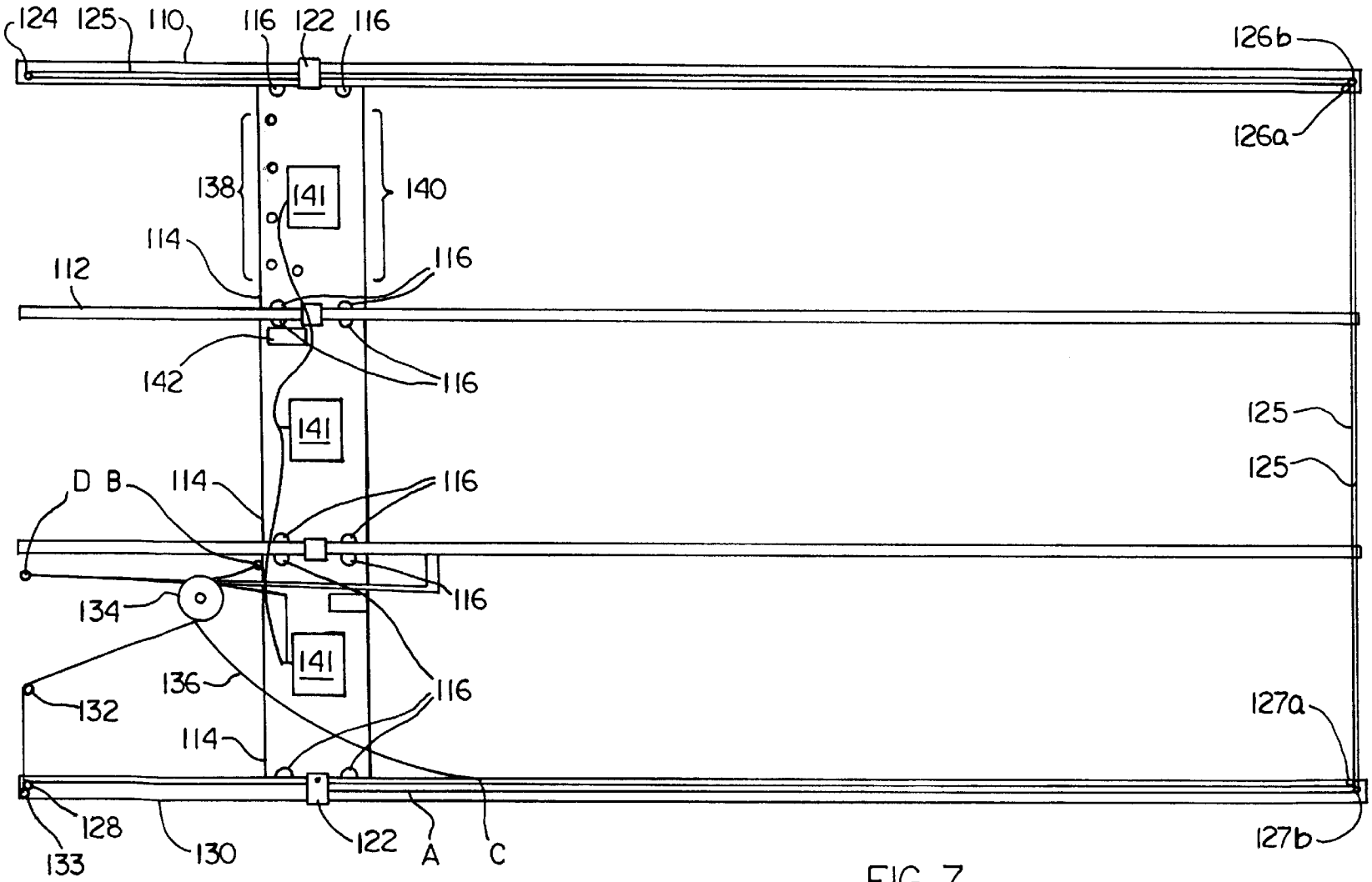
FIG. 7 is a rear elevational view of a sign made up of display elements and triggering mechanisms.

As shown in FIG. 7, carriages 114 are positioned at the rear of the apparatus and contain triggering mechanisms to rotate the display elements. Each carriage 114 contains four wheels 116, two positioned at the top of the carriage and two positioned at the bottom. Horizontal support beams 112 span the length of the apparatus and provide guides for the carriage wheels 116 as the carriage moves back and forth across the rear of the display. More than one carriage may be vertically connected to cover the vertical width of the apparatus. As shown in FIG. 7, three separate carriages 114 are joined by connecting brackets 122 that allow for a small amount of vertical movement between stacked carriages 114 to prevent binding of the carriages on the horizontal support beams 112 yet still allow for a constant horizontal alignment.

The carriages 114 are driven by a drive cable system that utilizes a single motor and drum 124. The drum 124 has a concave, or modified V, surface (not shown) to insure proper wrapping of the drive cable 125. Several wraps of the drive cable insure sufficient friction to overcome any slippage when driving the carriages 114. The drum operates similar to a windlass.

Figure 8:
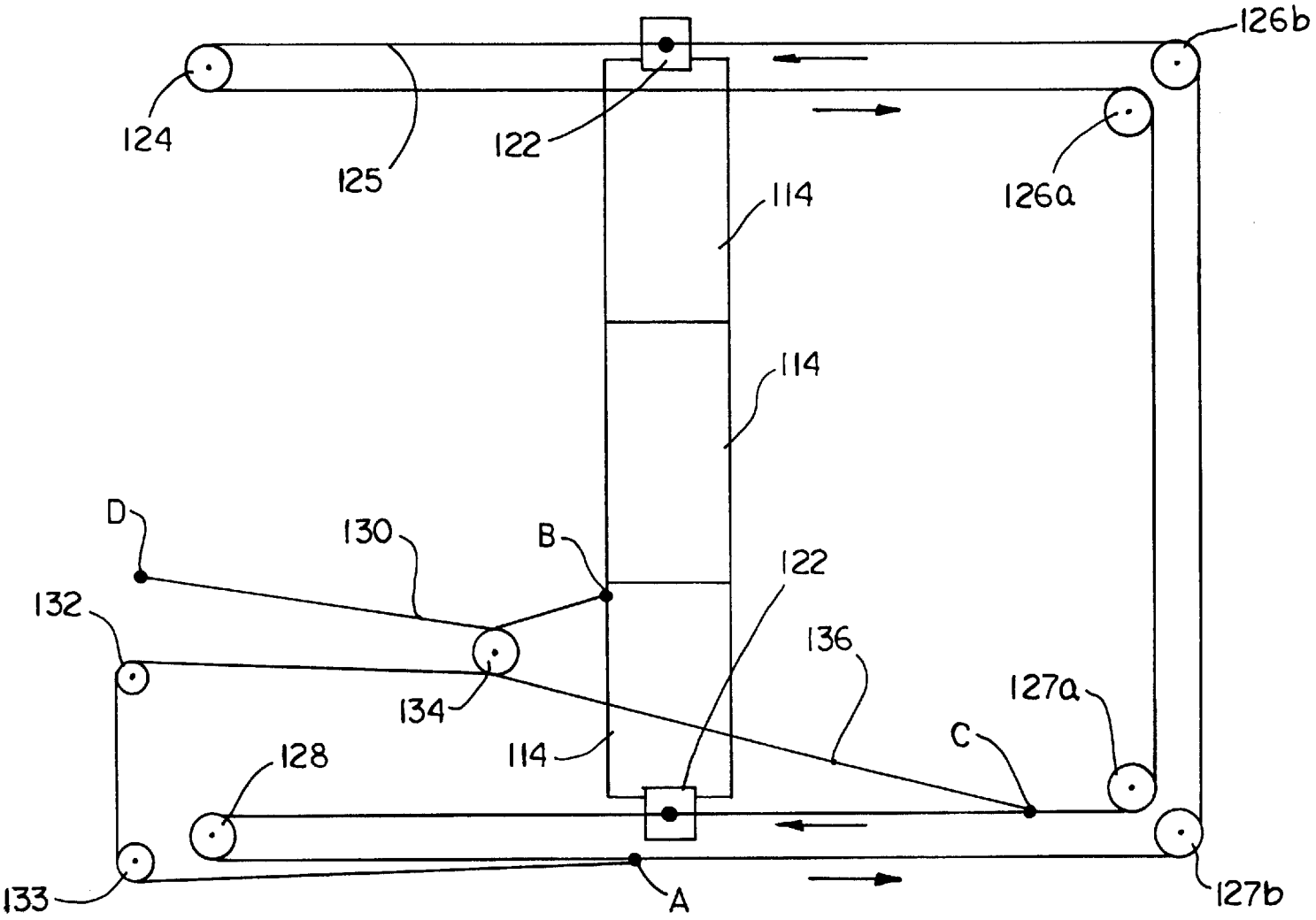
FIG. 8 is a schematic of the cable assembly of the embodiment shown in FIG. 7.

In the preferred embodiment of the cable system shown schematically in FIG. 8, drive cable 125 forms a continuous endless loop that runs around the top, one side, and bottom of the frame (shown in FIG. 7). From drum 124, located at one end of the upper-most horizontal support beam 112, the drive cable 125 travels along a path over drive cable pulley 126*a* which is positioned at the opposite end of the uppermost horizontal support beam 112. Drive cable pulley 126*a* provides a 90° direction change to feed drive cable 125 where drive cable pulley 127*a* provides a further 90° direction change. Drive cable 125 then travels the length of the bottom-most horizontal support beam 112, where it is wrapped around drive cable pulley 128 to effect a 180° direction change.

Drive cable 125 is then routed back along frame 110 in a path parallel to that just described. As before, drive cable pulleys 127*b* and 126*b* provide the necessary 90° direction changes to guide drive cable 125 back to drum 124, where the loop is closed. Drive cable 125 is attached to the uppermost and lowermost carriages 114 by means of connecting brackets 122. The connecting brackets 122 are respectively connected to the portion of the drive cable 125 travelling in the same direction. The configuration of the drive cable 125 allows the portion of drive cable 125 connected to the uppermost carriage 114 to move in the same direction and at the same speed as a portion of drive cable 125 connected at the lowermost carriage 114. Thus, the configuration of drive cable 125 provides uniform horizontal motion for vertically stacked carriages 114.

Shortening of the drive cable 125 and elimination of one drive cable pulley 126, 127 can be accomplished by routing a portion of the drive cable 125 diagonally across the frame to provide the direction change. However, in such an embodiment, there is a potential that the diagonal drive cable 125 will snag the carriage as it scans across the sign. Therefore, drive cable 125 is preferably routed away from carriages 114 as shown in FIG. 7 along the periphery of the frame 110.

At this point, the vertically stacked carriages 114 are driven back and forth via the drum 124 and drive cable 125. The carriages 114 require a control signal to control the display elements 16. In order to prevent the control signal cable 136 from becoming entangled or caught in the numerous moving parts of the apparatus, a novel pulley system was designed to work in conjunction with the drive cable 125. The signal cable 136 is connected to one of the carriages 114 at point B and to a portion of the drive cable 125 traveling in the same direction as the carriages 114 at point C. A constant tension is kept on the signal cable 136 using a retriever cable 130 operating in conjunction with a movable pulley 134. The retriever cable 130 is fixed at one end to a point D, preferably on frame 110. The other end of the retriever cable 130 is routed around pulleys 132 and 133 and ultimately connected to the drive cable 125 at a portion traveling in the opposite direction of the cable at point A. Configuring the retrieval cable 130 in this manner allows the movable pulley 134 to move in the same direction as the carriages 114, but at half the speed in order to compensate for the pulley action associated with the signal cable 136. The net effect of this cable configuration provides constant tension for both the retriever cable 130 and the signal cable 136 as the carriages 114 move in both directions.

As seen in FIG. 7, each carriage supports a series of eight solenoids 138 equally spaced vertically, except for the top, and a series of eight fixed reset pins 140 that are also equally spaced vertically, except for the top. The top reset pin and solenoid are vertically juxtaposed in order to provide clearances so the desired spacing between the grid modules can be achieved. The timing difference caused by the juxtaposition of the solenoid and reset pin is compensated by electronic means. Each carriage also contains a driver board 141 that controls the eight solenoids 138 on each carriage 114. Reset pins 140 may be attached to a movable platform, so the reset function can be controlled. A fixed reset bar may be used if reset or retrace is desired. The reset pins may be replaced by solenoids so selective setting and resetting can be achieved, or a solenoid with an escapement containing a set and reset pin can be used to achieve selective set and reset functions. Selective set and reset is especially useful if the sign is to be changed by a logic seeking technique. Other ways of using escapements or offset solenoid plunger pins could be used, but the embodiment described is the simplest.

Both the solenoids 138 and reset pins 140 are horizontally offset so that there are four odd numbered solenoids in one column, four even numbered solenoids in a second column, four odd numbered reset pins in a third column, and four even numbered reset pins in a fourth column. The utilization of separate columns provides a time lag for the even and odd rows of display elements to set or reset. This allows the display elements to be placed close together, since vertically adjacent display elements do no rotate at the same time and therefore can each use marginal spaces above and below the display element volumes during rotation, without interfering with one another.

The solenoids used in the preferred embodiment are either tubular or open frame solenoids and are mounted in holes at the front of the carriages 114. This technique makes the solenoids virtually self-aligning, eliminating the requirement of a fixture to properly align frame-type solenoids.

The solenoids, carriages, and cable systems are disclosed in application Ser. No. 08/761,125 filed Dec. 6, 1996, which is incorporated herein by reference.

The embodiments shown and described herein have been for the purpose of illustration of the invention. Those of ordinary skill in the art will appreciate that the invention can be carried out in various forms other than those specifically shown. Such variations are deemed to be within the scope of the claims. Also, various combinations and subcombinations of the features of the invention can be used without going beyond the scope of the invention.

What is claimed is:

1. A display apparatus comprising:

a plurality of axles, each of said axles being capable of emitting light at a plurality of selected locations along the axle;

a plurality of display elements rotationally mounted to each of said axles at said selected locations such that light may be emitted through each display element;

said display elements having shutters operable at selective rotational positions of said display elements to vary the amount of light that is emitted through said display elements;

a trigger for selective rotation of each display element about said axles; and a light source arranged to emit light through said axles to provide illumination for said display elements.

2. The apparatus of claim 1, wherein said axles support said display elements in a matrix of columns and rows.

3. The apparatus of claim 1, wherein said light source includes two units located at ends of said axles such that light is transmitted along the axles to the display elements, said light source units each being independently capable of illuminating said axles and said display elements.

4. The apparatus of claim 1, wherein said axles each have a first end and a second end, the apparatus further including a single light source located at one of said axle ends such that light is radiated through the length of the axles.

5. The apparatus of claim 1, further including light tubes each having an inner end and an outer end, said inner end connected to said axle end and said outer end connected to said light source such that light emitted from said light source can be directed to said axles.

6. The apparatus of claim 1, wherein said axle includes a reflective material to enhance light transfer along said axle.

7. The apparatus of claim 5, wherein said light tubes are flexible fiber optic bundles.

8. The apparatus of claim 1, wherein said trigger includes a plurality of vertically arrayed carriages, and a cable drive system, each said carriage carrying a plurality of actuators arranged to selectively pivot said display elements.

9. The apparatus of claim 1, wherein said axles are constructed of a solid light transmitting material to allow light from said light source to pass along said axle.

10. The apparatus of claim 9, wherein said axles emit light at said selected locations at an angle substantially perpendicular to an axle axis.

11. The apparatus of claim 10, wherein said axles are rigid members placed over said light source for connecting said display elements.

12. The apparatus of claim 1, wherein said display elements further include at least two visually different display faces, only one of which will be displayed at a given time for providing a desired arrangement of said display faces at said front of said display apparatus.

13. The apparatus of claim 12, wherein said display element has two transparent display faces that both allow for passing of light.

14. The apparatus of claim 12, wherein a first display face allows for passing of light and a second display face is opaque for occluding light passage.

15. The apparatus of claim 12, wherein one of said display faces has a molded lens to distribute light emitted from said light source outwardly away from said display face.

16. The apparatus of claim 12, wherein said display faces further include at least one trans-reflective label, said label having transparent and reflective indicia spaced about the label to allow light from said light source to be emitted between said reflective indicia to provide for high visibility during low ambient lighting conditions, said labels further providing for high visibility during daylight hours by reflecting ambient lighting.

17. The apparatus of claim 1, wherein said shutters comprise sleeves with apertures to permit selective light passage from the axles outwardly through the apertures.

18. The apparatus of claim 17, wherein said shutters are formed of a resilient material and have an open slot to permit mounting of said sleeves over said axles.

19. The apparatus of claim 17, wherein each of said display elements include first and second joined display faces and shutter arms extending outwardly from the sleeve to support said first display face.

20. The apparatus of claim 19, wherein said second display face is light transmissive.

21. An apparatus for displaying indicia at a front side thereof, comprising:

A) a frame;

B) a plurality of stationary axles aligned in parallel arrangement each having a first end and a second end and each connected to said frame, each of said axles having a plurality of light emitting locations that emit light at a plurality of locations along the axle;

C) a plurality of display elements mounted on each of said axles, said display elements each having:

1) a plurality of visually distinct display faces, only one of which will be displayed at a given time, for providing a desired arrangement of said display faces at said front of said display apparatus;

2) a shutter integral with said display element having an aperture which controls the amount of light emitted from said axle through said display face, said shutter rotationally attached to said axle; and 3) a shutter arm connecting said display face to said shutter; and D) a triggering mechanism adapted for bidirectional movement behind said display elements for rotating said display elements.

22. The apparatus of claim 21, wherein said aperture is aligned with one of said display faces such that when said shutter is rotated about said axle such that said aperture is positioned over one of said light emitting locations, said light passes through said aperture and internally illuminates said display face.

23. The apparatus of claim 22, wherein as said shutter is rotated about said axle, said aperture is positioned away from said light emitting location so that light passes through said aperture in a direction away from said display face.

24. The apparatus of claim 8, wherein said display element has two transparent display faces which both allow for light to pass.

25. The apparatus of claim 23, wherein a first display face allows for light to pass and a second display face is opaque to occlude light passage.

26. The apparatus of claim 23, wherein said display faces further include a molded lens to distribute the light emitted from said axle outwardly away from said display face.

27. The apparatus of claim 23, wherein said display faces further include at least one trans-reflective label, said label having transparent and reflective indicia spaced about the label to allow light from said axle to be emitted between said indicia to provide for high visibility during low ambient lighting conditions, said labels reflecting ambient light during daylight hours providing high visibility.

28. The apparatus of claim 23, wherein said shutter is substantially "C"-shaped to conform to said axle and allows rotation of said display element about said axle.

29. The apparatus of claim 21, wherein the dimensions of said display elements allow said display elements to be placed close enough together, in horizontal and vertical planes, that they appear as one substantially continuous surface.

30. The apparatus of claim 29, wherein said axles are spaced a distance apart so that said display elements freely rotate without interfering or touching adjacent vertical or horizontal display elements.

31. An apparatus for displaying indicia at a display front thereof, comprising:

a plurality of light emitting axles, each of said axles having a length and being capable of emitting light at a plurality of selected locations along said length;

a plurality of display elements which are individually rotationally mounted to each of said axles at said selected locations, said elements arranged in an array of rows and columns to provide a message on said display front; and a shutter integral with each of said display elements that controls the amount of light emitted through said display elements.

32. The apparatus of claim 31, wherein said axles include a plurality of individual light sources located at said selected locations.

33. The apparatus of claim 31, wherein each of said display elements further includes two visually distinct display faces selectively positionable to provide a desired arrangement at said front of said display apparatus, said display faces being located in proximity to said axle so that light emitted from said axle illuminates said display faces.

34. The apparatus of claim 33, wherein each of said shutters is rotationally mounted to one of said axles to display each of said display faces at the display front.

35. The apparatus of claim 33, wherein said shutter further includes an aperture that rotates about said light emitting axle locations for controlling an amount of light that is emitted from said axle to said display faces.

36. The apparatus of claim 35, wherein a first display face allows for light passage and a second display face is opaque to occlude light passage.

37. The apparatus of claim 36, wherein said display faces further include a molded lens to distribute the light emitted from said light source outwardly away from said display face.

38. The apparatus of claim 37, wherein said display faces further include at least one trans-reflective label, said label having transparent and reflective indicia spaced about the label to allow light from said light source to be emitted between said indicia to provide for high visibility during low ambient lighting conditions, said labels reflecting ambient light during daylight hours providing high visibility.

39. The apparatus of claim 31, wherein display element dimensions allow said display elements to be placed close enough together, in horizontal and vertical planes, that they appear as one substantially continuous surface.

40. The apparatus of claim 39, wherein said axles are spaced a distance apart so that said display elements freely rotate without interfering or touching adjacent vertical or horizontal display elements.

41. A display element adapted to be mounted onto a light-emitting axle to contribute to forming a matrix of horizontal rows and vertical columns for displaying indicia at a display front thereof, said display element comprising:

a shutter shaped as a bearing so as to be capable of being mounted on a light-emitting axle and having an aperture to allow light to pass radially from said axle;

a plurality of visually distinct display faces, one of which will be displayed at a given time to permit a selected arrangement for displaying indicia; and a shutter arm connecting said shutter to said display faces.

42. The display element of claim 41, wherein said shutter has an axial length substantially equal to a width of said display faces to prevent light from being emitted between horizontally adjacent display elements.

43. The display element of claim 41, wherein one of said display faces is aligned with said shutter aperture.

44. The display element of claim 43, wherein said shutter arm is positioned out of alignment of said aperture and said one display face.

45. The display element of claim 41, further comprising a ramp connected to each of said display faces.

* * * * *